US012158153B2

(12) United States Patent
Inouchi

(10) Patent No.: US 12,158,153 B2
(45) Date of Patent: Dec. 3, 2024

(54) BLOWER

(71) Applicant: Nidec Corporation, Kyoto (JP)

(72) Inventor: Kazuhiro Inouchi, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 108 days.

(21) Appl. No.: 18/108,703

(22) Filed: Feb. 13, 2023

(65) Prior Publication Data

US 2023/0265853 A1 Aug. 24, 2023

(30) Foreign Application Priority Data

Feb. 18, 2022 (JP) ..... 2022-024144

(51) Int. Cl.

| | |
|---|---|
| ***F04D 25/06*** | (2006.01) |
| ***F04D 17/16*** | (2006.01) |
| *F04D 25/08* | (2006.01) |
| *F04D 25/16* | (2006.01) |
| *F04D 29/00* | (2006.01) |
| *F04D 29/42* | (2006.01) |
| *F04D 29/44* | (2006.01) |

(52) U.S. Cl.

CPC ..... *F04D 25/0613* (2013.01); *F04D 17/16* (2013.01); *F04D 25/06* (2013.01); *F04D 25/08* (2013.01); *F04D 25/166* (2013.01); *F04D 29/002* (2013.01); *F04D 29/4226* (2013.01); *F04D 29/4246* (2013.01); *F04D 29/441* (2013.01)

(58) Field of Classification Search

CPC ..... F04D 29/002

See application file for complete search history.

(56) References Cited

U.S. PATENT DOCUMENTS

| | | | | |
|---|---|---|---|---|
| 6,030,173 | A * | 2/2000 | Bacchiocchi | F24C 15/20 415/206 |
| 8,876,499 | B2 * | 11/2014 | Horng | F04D 25/0613 415/206 |
| 9,447,789 | B2 * | 9/2016 | Chang | F04D 29/541 |
| 9,574,568 | B2 * | 2/2017 | Dickinson | F04D 25/166 |

* cited by examiner

*Primary Examiner* — Nathan C Zollinger
*Assistant Examiner* — Timothy P Solak
(74) *Attorney, Agent, or Firm* — Keating & Bennett, LLP

(57) ABSTRACT

A blower includes a base, a motor attached to the base, a first impeller to be rotated by the motor, and a second impeller to be rotated by the motor and independent of the first impeller. The base includes an annular cover that covers at least a portion of the motor, a support that extends from an upper end of the cover, and a bottom extending inward from a lower end of the cover and to which the stator is fixed. The bottom includes a shaft hole to accommodate a shaft. The first impeller and the second impeller are fixed to an upper portion and a lower portion of a rotor, respectively. At least one of the first impeller and the second impeller is fixed to the shaft.

9 Claims, 5 Drawing Sheets

BLOWER

CROSS-REFERENCE TO RELATED APPLICATIONS

The present application claims priority under 35 U.S.C. § 119 to Japanese Patent Application No. 2022-024144, filed on Feb. 18, 2022, the entire contents of which are hereby incorporated herein by reference.

1. FIELD OF THE INVENTION

The present disclosure relates to a blower.

2. BACKGROUND

Conventionally, in order to improve air blowing performance and cooling performance, a fan motor in which intake holes are formed on both surfaces of a case sandwiching a fan has been proposed.

In the conventional fan motor described above, since a base provided with a bearing tube for fixing a drive unit for rotating the fan and a rib for supporting the base are provided to one intake hole of the casing, the intake hole becomes narrow, which causes a decrease in air volume and generation of noise. In addition, in order to obtain a sufficient air volume, it is necessary to enlarge the intake hole, so that the fan motor becomes large.

SUMMARY

A blower according to an example embodiment of the present disclosure includes a base, a motor attached to the base, a first impeller to be rotated by the motor, and a second impeller to be rotated by the motor and independent of the first impeller. The motor includes a rotor including a shaft that extends vertically and is rotatable about the central axis, a stator fixed to the base and radially opposing the rotor, and a bearing fixed to the stator and rotatably supporting the rotor. The base includes an annular cover that covers at least a portion of the motor with the central axis being the center, a support that extends outward from an upper end of the cover, and a bottom that extends inward from a lower end of the cover and to which the stator is fixed. The bottom includes a shaft hole to accommodate the shaft, the first impeller and the second impeller are attached to an upper portion and a lower portion of the rotor, respectively, and at least one of the first impeller and the second impeller is fixed to the shaft.

The above and other elements, features, steps, characteristics and advantages of the present disclosure will become more apparent from the following detailed description of the example embodiments with reference to the attached drawings.

DETAILED DESCRIPTION

Hereinafter, motor assemblies according to example embodiments of the present disclosure will be described with reference to the drawings. Note that the scope of the present disclosure is not limited to the example embodiments described below, but includes any modification thereof within the scope of the technical ideas of the present disclosure.

In the present specification, a direction parallel to a central axis Cx of a motor 30 is referred to by the term "axial direction", "axial", or "axially". With reference to the state of the motor 30 illustrated in FIG. 1, the upper side is defined as one axial direction, and the lower side is defined as the other axial direction. In addition, a radial direction orthogonal to the central axis Cx is simply referred to as a "radial direction", and a circumferential direction around the central axis Cx is simply referred to as a "circumferential direction". Further, a "parallel direction" described in the present specification includes not only a completely parallel direction, but also a substantially parallel direction. Then, "extending along" a predetermined direction or a plane includes not only a case of extending strictly in a predetermined direction but also a case of extending in a direction inclined within a range of less than 45° with respect to the exact direction.

The blower A according to an example embodiment of the present disclosure will be described below with reference to the drawings.

Figure 1:
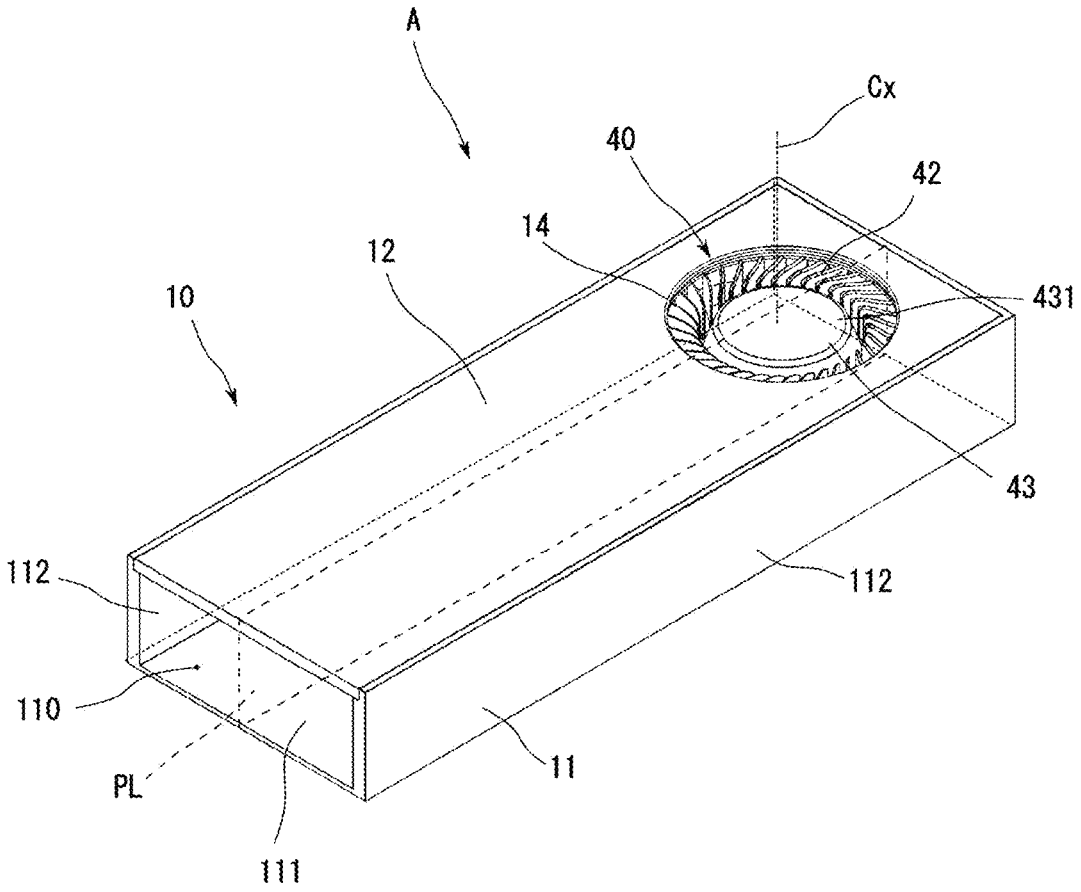
FIG. 1 is a perspective view of a blower according to an example embodiment of the present disclosure.
Figure 2:
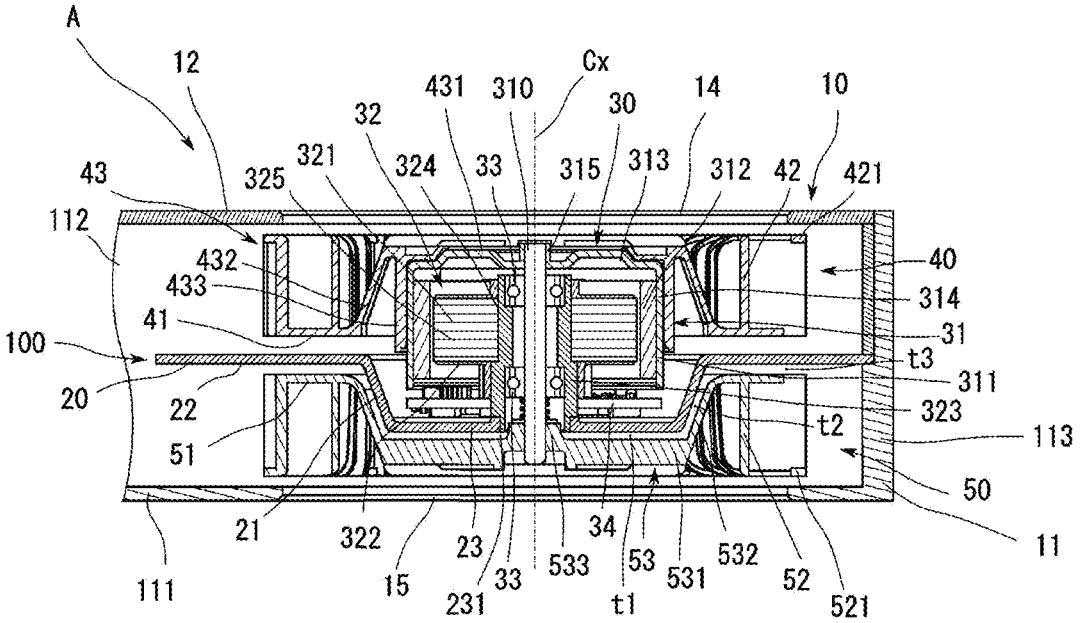
FIG. 2 is a partial cross-sectional view illustrating a portion of a cross section of the blower taken along a cross section illustrated in FIG. 1.
Figure 3:
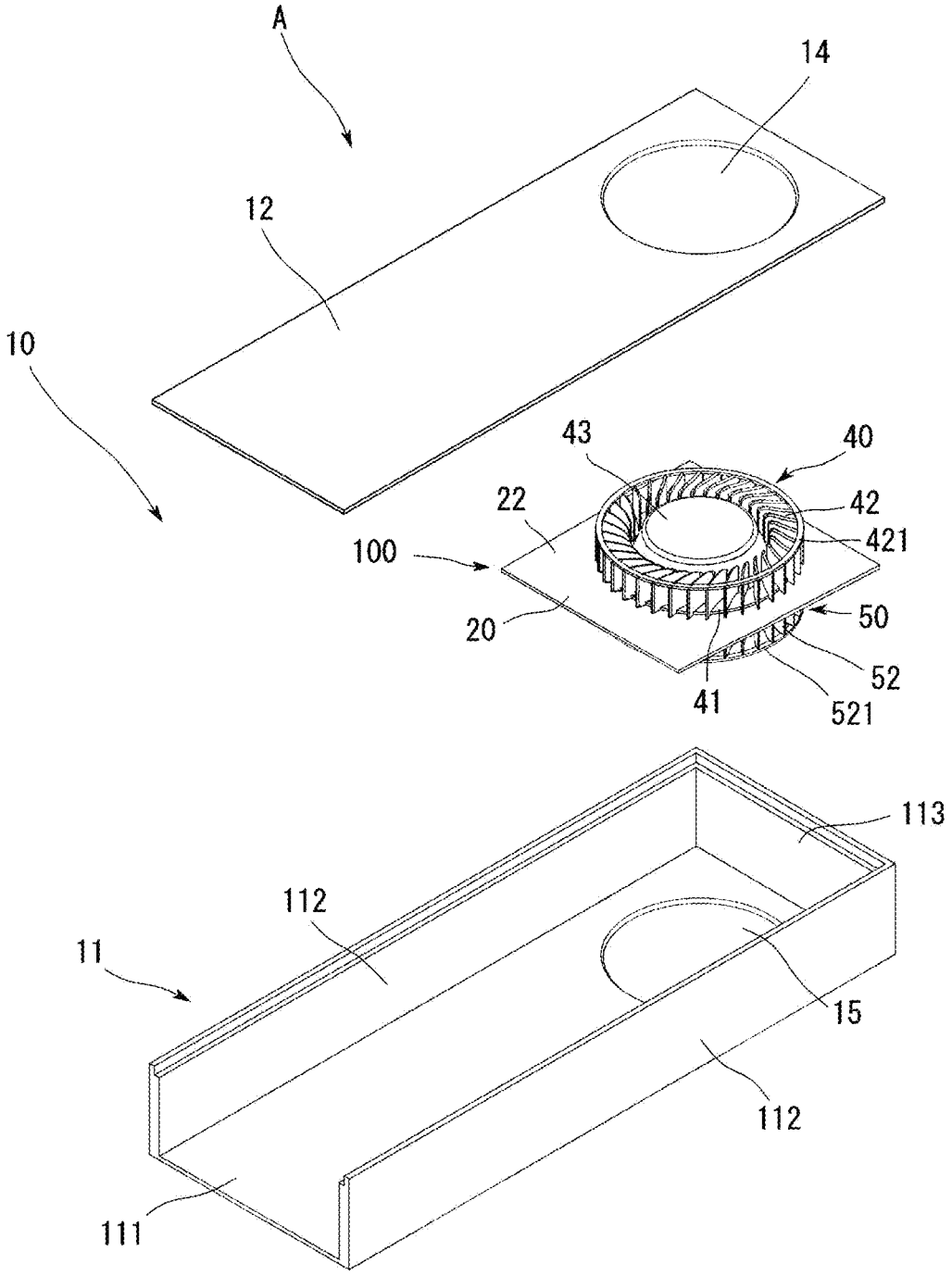
FIG. 3 is an exploded perspective view of the blower.

FIG. 1 is a perspective view of the blower A of one example embodiment. FIG. 2 is a partial cross-sectional view illustrating a part of a cross section of the blower A taken along a cross section PL illustrated in FIG. 1. FIG. 3 is an exploded perspective view of the blower A. Note that the drawings used in the present example embodiment are conceptual diagrams. The arrangement and dimensions of each part shown in each drawing are not necessarily the same as those of the actual blower A.

Figure 4:
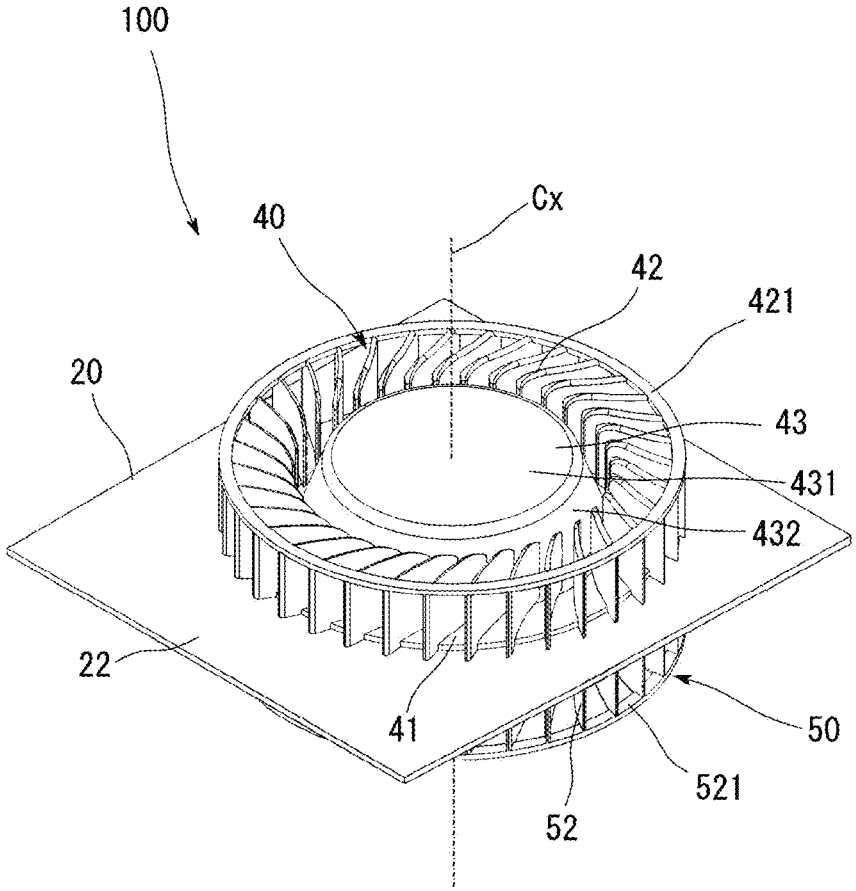
FIG. 4 is a perspective view of a blower assembly.
Figure 5:
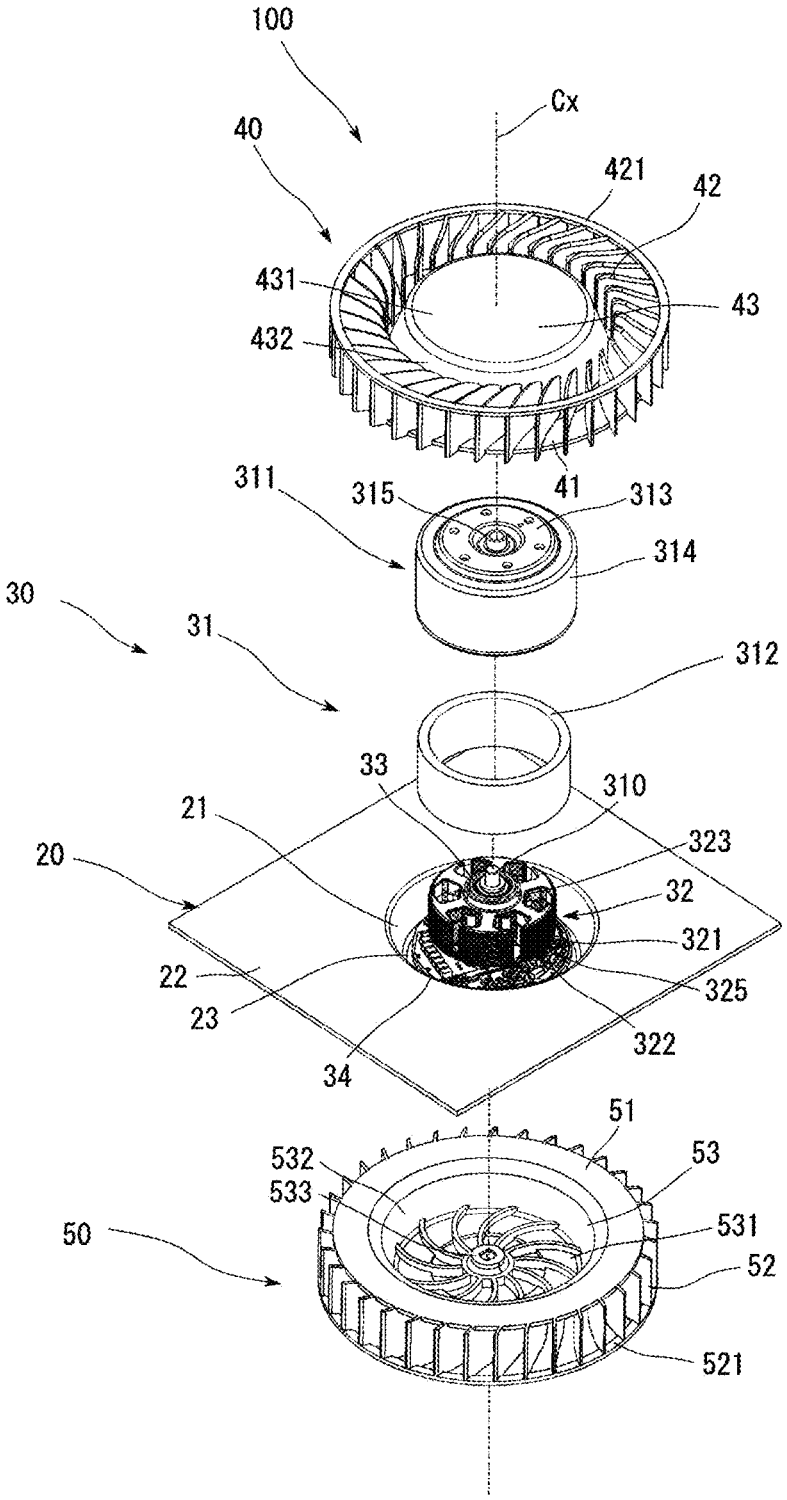
FIG. 5 is an exploded perspective view of the blower assembly.

As shown in FIGS. 1 and 2, the blower A includes a housing 10, a base portion 20, a motor 30, a first impeller 40, and a second impeller 50. The base portion 20 is formed of the same material as that of the housing 10. The motor 30, the first impeller 40, and the second impeller 50 are attached to the base portion 20. In the following description, a configuration in which the motor 30, the first impeller 40, and the second impeller 50 are attached to the base portion 20 may be referred to as a blower assembly 100. FIG. 4 is a perspective view of the blower assembly 100. FIG. 5 is an exploded perspective view of the blower assembly 100.

As illustrated in FIG. 1, the housing 10 is a box having a substantially rectangular parallelepiped shape. One end portion of the housing 10 in the longitudinal direction is opened. This opening is a discharge port 110 for discharging an air flow generated inside. As illustrated in FIGS. 2 and 3, the blower assembly 100 is disposed inside the housing 10. That is, the base portion 20, the motor 30, the first impeller 40, and the second impeller 50 are disposed inside the housing 10.

The housing 10 includes a container portion 11 and a lid portion 12. The container portion 11 has a rectangular bottom plate 111 when viewed from the axial direction. The container portion 11 includes a pair of long plate portions 112 extending upward from the two long sides of the bottom plate 111 respectively and a short plate portion 113 extending upward from one of the short sides.

As illustrated in FIG. 3 and elsewhere, a second intake port 15 penetrating in the thickness direction is formed in the bottom plate 111. The second intake port 15 has a circular shape when viewed from the axial direction. When the airflow is generated by the rotation of the second impeller 50, the air is sucked into the housing 10 from the second intake port 15. The shape of the second intake port 15 as viewed from the axial direction is not limited to a circular shape, and shapes that can suck air, such as an elliptical shape, a polygonal shape (square, hexagon, etc.), and a shape obtained by combining these shapes, can be widely adopted. In addition, a filter may be disposed to suppress mixing of foreign matter.

As illustrated in FIG. 2, the lid portion 12 is disposed so as to vertically face the bottom plate 111. The lid portion 12 is fixed to the upper ends of the pair of long plate portions 112 and the short plate portion 113. The lid portion 12 can be fixed by using screws, but is not limited thereto. For example, a fixing method such as press-fitting or fixing by claws can be adopted. As a method of fixing the lid portion 12, a method of firmly fixing the lid portion 12 to the long plate portions 112 and the short plate portion 113 can be widely adopted.

As illustrated in FIGS. 1, 3 and elsewhere, a first intake port 14 penetrating in the thickness direction is formed in the lid portion 12. The first intake port 14 has a circular shape when viewed from the axial direction. When the airflow is generated by the rotation of the first impeller 40, the air is sucked into the housing 10 from the first intake port 14. The shape of the first intake port 14 as viewed from the axial direction is not limited to a circular shape, and shapes that can suck air, such as an elliptical shape, a polygonal shape (square, hexagon, etc.), and a shape obtained by combining these shapes, can be widely adopted. In addition, a filter (not illustrated) may be disposed to suppress mixing of foreign matter.

As illustrated in FIGS. 2 to 5, the base portion 20 includes a cover portion 21, a support portion 22, and a bottom portion 23. The cover portion 21 has an annular shape centered on the central axis Cx and covers at least a part of the motor 30 in the radial direction. In the blower A of the present example embodiment, the cover portion 21 has a tubular shape centered on the central axis Cx. The cover portion 21 approaches the central axis Cx as it goes downward. More specifically, the cover portion 21 has a tapered shape. Note that the cover portion 21 is not limited to a tapered shape, and may be a cylindrical shape.

The support portion 22 has a flat plate shape. The support portion 22 extends radially outward from the upper end of the cover portion 21. The bottom portion 23 has a flat plate shape. The bottom portion 23 extends inward from the lower end of the cover portion 21.

A stator 32, to be described below, of the motor 30 is fixed to the bottom portion 23.

As illustrated in FIG. 2, the bottom portion 23 has a shaft hole 231 penetrating in the axial direction (see FIG. 2).

A shaft 310, to be described later, of the motor 30 is disposed in a state of penetrating the shaft hole 231. In the blower A according to the present example embodiment, the cover portion 21, the support portion 22, and the bottom portion 23 of the base portion 20 are integrally formed, but the present disclosure is not limited thereto. For example, the cover portion 21, the support portion 22, and the bottom portion 23 may be formed as separate members and fixed.

In the blower A of the present example embodiment, the support portion 22 of the base portion 20 is fixed to the housing 10. As a result, the base portion 20 is held by the housing 10. Note that the fixing of the support portion 22 to the housing 10 may be performed, for example, by sandwiching the support portion with the protruding portions formed on the bottom plate 111 and the lid portion 12. Alternatively, a rib may be formed on the outer peripheral portion of the support portion 22 and bonded to the inner peripheral surface of the housing 10. Even a method other than these, a fixing method that can stably fix the support portion 22 to the housing 10 can be widely adopted.

As shown in FIGS. 2 and 5, the motor 30 includes a rotor 31, a stator 32, two bearing portions 33, and a circuit board 34. The motor 30 is a so-called outer rotor type brushless DC motor, and the rotor 31 faces the radial outer surface of the stator 32 in the radial direction. By adopting the outer rotor motor as the motor 30, a larger torque can be generated as compared with the case of using the inner rotor motor, and the air volume of the blower A can be increased.

As illustrated in FIG. 2, the rotor 31 has a shaft 310 that rotates about the central axis Cx extending vertically. In the motor 30 according to the present example embodiment, the shaft 310 has a columnar shape, but is not limited thereto, and may have a cylindrical shape as long as sufficient rigidity can be secured.

The rotor 31 includes a rotor case 311 and a rotor magnet 312. The rotor case 311 has a covered cylindrical shape formed of a magnetic material, and includes a lid portion 313 and a cylindrical portion 314. The lid portion 313 has a shaft fixing portion 315 at the center. The shaft fixing portion 315 has a tubular shape extending upward along the axis from a peripheral edge of a through hole formed at the center of the lid portion 313. The shaft 310 is fixed to the inner peripheral surface of the shaft fixing portion 315. That is, the rotor case 311 is fixed to the shaft 310.

Note that press-fitting is adopted as a method of fixing the shaft 310 and the shaft fixing portion 315.

However, the fixing method is not limited to press-fitting, and a fixing method capable of firmly fixing the shaft 310 and the shaft fixing portion 315 without hindering the rotation of the shaft 310, such as adhesion, welding, and screwing, can be widely adopted. By fixing the shaft 310 to the shaft fixing portion 315, the shaft 310 and the rotor 31 are fixed.

The cylindrical portion 314 has a cylindrical shape and extends downward along the axial direction from the radial outer edge of the lid portion 313. The rotor magnet 312 is fixed to the inner peripheral surface of the cylindrical portion 314. The rotor magnet 312 has a cylindrical shape. The rotor case 311 has a tubular shape and holds the rotor magnet 312 on the inner peripheral surface. The rotor magnet 312 is disposed radially outside the stator 32.

In at least the inner peripheral surface of the rotor magnet 312, N poles and S poles are alternately arranged in the circumferential direction. In the present example embodiment, the rotor magnet 312 has a cylindrical shape, but is not limited thereto. For example, a plurality of flat plate-shaped magnets may be arranged in the circumferential direction on a cylindrical rotor core.

As illustrated in FIGS. 2 and 5, the stator 32 is disposed radially inside the rotor 31 and radially faces the rotor 31. More specifically, the stator 32 includes a stator core 321, an insulator 322, a coil (not illustrated), and a sleeve 323. The stator core 321 is a stacked body in which electromagnetic steel sheets are stacked in the axial direction. Note that the stator core 321 is not limited to a stacked body in which electromagnetic steel sheets are stacked, and may be a single member, such as a fired body of powder or a casting, for example.

A through hole 324 centered on the central axis Cx is formed at the center of the stator core 321. The stator core 321 includes a plurality of teeth 325. The plurality of teeth 325 extend radially outward. The plurality of teeth 325 are arranged at regular intervals in the circumferential direction. The radially outer edge of each of the teeth 325 has a shape extending in the circumferential direction. The radially outer edge of each of the teeth 325 is in a shape extending in the circumferential direction. With such a shape, the magnetic flux from the rotor magnet 312 can be efficiently received, and the coil is less likely to come off radially outward.

The insulator 322 is formed of an insulating material such as a resin and covers at least the teeth. As illustrated in FIG. 2, a coil is formed by winding a conductive wire around the teeth 325 covered with the insulator 322. To the coil, electric currents of three types having different phases (hereinafter referred to as three phases) are supplied.

The insulator 322 electrically insulates the stator core 321 from the coil. The insulator 322 is not limited to resin, and a material that can insulate the stator core 321 from the coil can be widely used. For example, when an insulating coating is applied to the conductive wire to insulate the conductive wire and the stator core 321 from each other, the insulator 322 may be omitted.

The sleeve 323 is in a cylindrical shape. The lower end of the sleeve 323 is inserted into a shaft hole 231 provided in the bottom portion 23 of the base portion 20. Thus, the sleeve 323 is fixed to the bottom portion 23. More specifically, the center of the sleeve 323 fixed to the bottom portion 23 overlaps with the central axis Cx. The sleeve 323 is fixed by being press-fitted into the shaft hole 231, but is not limited thereto. For example, as a fixing method, a fixing method that can firmly fix the sleeve 323 to the bottom portion 23 about the central axis Cx, such as adhesion, welding, and screwing, can be widely adopted.

The sleeve 323 is fixed to the through hole 324 of the stator core 321. In other words, the stator core 321 is fixed to the outer peripheral surface of the sleeve 323. Although the stator core 321 and the sleeve 323 are fixed by being inserted and bonded, the present disclosure is not limited thereto. For example, methods by which the stator core 321 can be fixed firmly to the sleeve 323, such as press-fitting, welding, screwing, can be widely adopted. Alternatively, the stator core 321 and the sleeve 323 may be fixed via a fixing member.

With the above configuration, the stator 32 is fixed to the base portion 20 and faces the rotor 31 in the radial direction.

The two bearing portions 33 are arranged with an axial interval inside the sleeve 323. The bearing portion 33 is a ball bearing. The outer ring is fixed to the inner surface of the sleeve 323, and the shaft 310 is fixed to the inner ring. As a result, the shaft 310 is supported by the sleeve 323 fixed to the base portion 20 so as to be rotatable about the central axis Cx. Among the two bearing portions 33, one bearing portion 33 is disposed above the base portion 20, and the other bearing portion 33 is disposed below the base portion 20. That is, the two bearing portions 33 are disposed apart from each other in the axial direction, and the inclination of the shaft 310 with respect to the central axis Cx is suppressed by disposing the two bearing portions 33 in this manner.

At least one of the two bearing portions 33 may be disposed at a position overlapping the base portion 20 in the radial direction. The number of the bearing portions 33 is not limited to two, and may be any number as long as the shaft 310 can be stably supported. That is, the bearing portion 33 is fixed to the stator 32 to rotatably support the rotor 31. The bearing portion may be a sleeve bearing.

In the motor 30, the sleeve 323 is fixed to the bottom portion 23 of the base portion 20, and the stator 32 is fixed to the outer surface of the sleeve 323. In addition, the shaft 310 is rotatably supported by the sleeve 323 via the bearing portion 33. That is, at least a part of the rotor case 311 is disposed radially inside the cover portion 21 and faces the cover portion 21 in the radial direction. In this manner, the motor 30 is attached to the base portion 20. At this time, the lower portion of the rotor case 311 of the rotor 31 is disposed radially inside the cover portion 21 of the base portion 20 and radially faces the cover portion 21.

The circuit board 34 is arranged below the stator 32 in the axial direction. The pattern wiring is formed on the circuit board 34. Then, electronic components are arranged on the circuit board 34, and a circuit using the electronic components is formed by the pattern wiring. Note that as the circuit board 34, for example, a power supply circuit for supplying electric power to the coil can be exemplified. Further, a circuit other than the power supply circuit may be formed. A coil is connected to the circuit board 34 via a bus bar, not illustrated, or the like.

The circuit board 34 is disposed radially inside the cover portion 21. A conductive wire (not illustrated) connected to a control circuit (not illustrated) provided outside is connected to the circuit board 34. The conductive wire is wired on the surface of the support portion 22 of the base portion 20 and is wired to the circuit board 34 through a gap between the cover portion 21 and the motor 30. Since the cover portion 21 is formed in a tapered shape, a gap is formed between the cover portion 21 and the rotor case 311, so that the conductive wire can be easily routed. In order to wire the conductive wire, the axial gap between the first impeller 40 and the base portion 20 may be wider than the axial gap between the second impeller 50 and the base portion 20. In addition, these gaps may be the same when not interfering with the conductive wire.

In the motor 30, each coil is sequentially excited by sequentially supplying a current to a plurality of coils. The shaft 310 and the rotor 31 integrally rotate about the central axis Cx by the magnetic force generated between the coil and the rotor magnet 312.

As illustrated in FIGS. 2 to 5, the first impeller 40 is a centrifugal impeller that blows out the air taken in from one end portion in the axial direction to the outer periphery in the radial direction. The first impeller 40 includes a first base plate 41, a plurality of first blades 42, and a first impeller cup 43.

The first base plate 41 has an annular shape. The first base plate 41 is orthogonal to the central axis Cx. The plurality of first blades 42 are attached to the first base plate 41. More specifically, the first blade 42 extends upward along the axial direction from the upper surface of the first base plate 41. The plurality of first blades 42 are arranged at regular intervals in the circumferential direction. An annular member 421 is attached to the upper end of the first blade 42. By attaching the annular member 421, the rigidity of the first blade 42 can be enhanced. As a result, the first blade 42 is less likely to be bent in air blowing, and air blowing efficiency can be enhanced. When the rigidity of the first blade 42 is high, the annular member 421 may be omitted.

The first impeller cup 43 has a lidded cylindrical shape. The first impeller cup 43 has an opening at the bottom, and the first base plate 41 extends radially outward from the lower end of the first impeller cup 43. The center line of the first impeller cup 43 overlaps the center line of the first base plate 41. That is, the first base plate 41 and the first impeller cup 43 are integrally formed, and have an opening in the lower portion of the first impeller cup 43.

The first impeller cup 43 serves as an air guide portion for guiding the air sucked by the first impeller 40. The outer surface of the first impeller cup 43 is smoothly formed, and the air flow is hardly disturbed on the surface of the first impeller cup 43.

The first impeller cup 43 includes an impeller lid portion 431, an outer cylindrical portion 432, and an inner cylindrical portion 433. The impeller lid portion 431 has a disk shape extending in a direction orthogonal to the central axis Cx.

The outer cylindrical portion 432 extends downward along the central axis Cx from the outer edge portion of the impeller lid portion 431. More specifically, the outer cylindrical portion 432 is separated from the central axis Cx as it goes downward. The lower end of the outer cylindrical portion 432 is integrally connected to the inner peripheral end of the first base plate 41.

The inner cylindrical portion 433 has a cylindrical shape having a concentric axis with the outer cylindrical portion 432. The inner cylindrical portion 433 is formed integrally with the impeller lid portion 431, and extends downward along the central axis Cx from the lower surface of the impeller lid portion 431. The rotor case 311 of the rotor 31 of the motor 30 is fixed to the inner peripheral surface of the inner cylindrical portion 433. That is, the first impeller 40 is fixed to the rotor case 311. Thus, the first impeller 40 is attached to the motor 30.

The inner cylindrical portion 433 and the rotor case 311 are fixed by press fitting, for example. However, a method of fixing the inner cylindrical portion 433 and the rotor case 311 is not limited to press-fitting, and a fixing method of firmly fixing the inner cylindrical portion 433 and the rotor case 311, such as adhesion, solvent welding, or welding, can be widely adopted.

With this configuration, a part of the rotor case 311 of the motor 30 is disposed radially inside the first impeller 40. As a result, the blower A can be thinned, that is, downsized without deteriorating the blowing capacity.

The second impeller 50 is a centrifugal impeller that blows out the air taken in from the other end in the axial direction to the outer periphery in the radial direction. The second impeller 50 includes a second base plate 51, a plurality of second blades 52, and a second impeller cup 53.

In the second impeller 50, the second base plate 51 and the second blade 52 have the same shapes as the first base plate 41 and the first blade 42 of the first impeller 40. Therefore, details of the second base plate 51 and the second blade 52 are omitted. An annular member 521 is fixed to the lower end of the second blade 52 similarly to the first blade 42.

The second impeller cup 53 has a bottomed cylindrical shape. The second impeller cup 53 has an opening at the top, and the second base plate 51 extends radially outward from the upper end of the second impeller cup 53. The center line of the second impeller cup 53 overlaps the center line of the second base plate 51. That is, the second base plate 51 and the second impeller cup 53 are integrally formed, and have an opening in the upper portion of the second impeller cup 53.

The second impeller cup 53 serves as an air guide portion for guiding the air sucked by the second impeller 50. The outer surface of the second impeller cup 53 is smoothly formed, and the air flow is hardly disturbed on the surface of the second impeller cup 53.

As shown in FIGS. 2 to 5, the second impeller cup 53 has an impeller bottom portion 531, a cylindrical portion 532, and a fixing portion 533. The impeller bottom portion 531 has a disk shape extending in a direction orthogonal to the central axis Cx. The cylindrical portion 532 extends upward along the central axis Cx from the outer edge of the impeller bottom portion 531. The upper end of the cylindrical portion 532 is integrally connected to the inner peripheral end of the second base plate 51.

The fixing portion 533 is provided on the impeller bottom portion 531. The fixing portion 533 has a tubular shape extending in the axial direction from the impeller bottom portion 531. The shaft 310 is fixed to the fixing portion 533.

In the second impeller 50 according to the present example embodiment, the fixing portion 533 is integrated with the impeller bottom portion 531. That is, the second impeller 50 is directly fixed to the shaft 310. However, the present disclosure is not limited thereto, and the fixing portion 533 may be formed separately from the impeller bottom portion 531 and attached to the impeller bottom portion 531.

The fixing portion 533 and the shaft 310 are fixed by press fitting, for example. However, a method of fixing the fixing portion 533 and the shaft 310 is not limited to press-fitting, and a fixing method of firmly fixing the fixing portion 533 and the shaft 310, such as adhesion, solvent welding, or welding, can be widely adopted.

Next, a configuration of the blower assembly 100 will be described. In the blower assembly 100, the sleeve 323 of the motor 30 is fixed to the bottom portion 23 of the base portion 20, and the stator 32 is fixed to the outer surface of the sleeve 323. In addition, the shaft 310 is rotatably supported by the sleeve 323 via the bearing portion 33. In this manner, the motor 30 is attached to the base portion 20. At this time, the lower portion of the rotor case 311 of the rotor 31 is disposed radially inside the cover portion 21 of the base portion 20 and radially faces the cover portion 21. That is, at least a part of the rotor case 311 is disposed radially inside the cover portion 21 and faces the cover portion 21 in the radial direction. As a result, since the height in the axial direction can be suppressed, the impeller height can be increased, and the air volume characteristics can be improved.

In the blower assembly 100, an upper portion of the rotor case 311 protrudes upward from the support portion 22. The first impeller 40 is fixed to a portion of the rotor case 311 protruding upward from the support portion 22. As a result, the first impeller 40 is fixed to the rotor 31 in a state where there is a gap with the support portion 22.

The shaft 310 of the motor 30 protrudes downward from the bottom portion 23 of the base portion 20. The second impeller 50 is fixed to a portion of the shaft 310 protruding downward from the bottom portion 23.

As illustrated in FIG. 5 and elsewhere, a part of the cover portion 21 is disposed radially inside the second impeller cup 53 of the second impeller 50. That is, the second blade 52 of the second impeller 50 is disposed radially outside the cover portion 21, and at least a part thereof overlaps the cover portion 21 in the radial direction.

As described above, in the blower A, the first impeller 40 and the second impeller 50 are fixed to the upper portion and the lower portion of the rotor 31, respectively. Specifically, the first impeller 40 is fixed to the rotor 31 by fixing the inner cylindrical portion 433 to the rotor case 311. The second impeller 50 is fixed to the shaft 310 by fixing the fixing portion 533 to the shaft 310.

As shown in FIG. 2, when the second impeller 50 is fixed to the shaft 310, a gap between the impeller bottom portion 531 of the second impeller cup 53 of the second impeller 50 and the bottom portion 23 of the base portion 20 is defined as t1. A gap between the cylindrical portion 532 of the second impeller cup 53 of the second impeller 50 and the cover portion 21 of the base portion 20 is defined as t2. A gap between the second base plate 51 of the second impeller 50 and the support portion 22 of the base portion 20 is defined as t3. At this time, the gap t3 is larger than the gap t1 and the gap t2.

When the motor 30 swings at the time of startup, sudden stop, or the like, the displacement is small in a portion close to the central axis Cx, and the displacement increases as the distance increases. That is, when the motor 30 swings, the displacement of the second base plate 51 is larger than the displacement of the second impeller cup 53. It is possible to save time and effort for replacement. Since the gap t3 is larger than the gap t1 and the gap t2, contact between the second impeller 50 and the base portion 20 is suppressed even when the motor 30 swings.

The gap t1, the gap t2, and the gap t3 are lengths by which the impeller bottom portion 531 and the bottom portion 23, the cylindrical portion 532 and the cover portion 21, and the second base plate 51 and the support portion 22 do not come into contact with each other when the motor 30 swings. More specifically, the gaps t1, t2, and t3 may be formed so as to increase as the distance from the central axis Cx increases. In particular, in the gap t3 away from the central axis Cx, a higher effect can be obtained.

Note that both the first impeller 40 and the second impeller 50 may be directly fixed to the shaft 310. That is, in the blower A, at least one of the first impeller 40 and the second impeller 50 is fixed to the shaft 310.

The base portion 20 is positioned with respect to the bottom plate 111, the long plate portion 112, and the short plate portion 113 of the housing 10, and is disposed inside the housing 10. As a result, the second intake port 15 formed in the bottom plate 111 is disposed below the second impeller 50. That is, the second intake port 15 is disposed below the second impeller 50 and axially faces the second impeller 50. The first impeller 40 and the second impeller 50 are disposed with a gap from the inner wall surfaces of the long plate portion 112 and the short plate portion 113 of the container portion 11 in the radial direction.

Then, the lid portion 12 is attached to the top of the container portion 11. Since the lid portion 12 is attached, the first intake port 14 formed in the lid portion 12 is disposed above the first impeller 40.

That is, the first intake port 14 is disposed above the first impeller 40 and axially faces the first impeller 40. In this state, the lid portion 12 is fixed to the long plate portion 112 and the short plate portion 113 of the container portion 11. The base portion 20 is fixed to the housing 10.

In the blower A thus formed, the first impeller 40 and the second impeller 50 rotate together with the rotor 31 when the motor 30 is operated. That is, the blower A includes the first impeller 40 rotated by the motor 30 and the second impeller 50 rotated by the motor 30 and independent of the first impeller 40.

When the first impeller 40 rotates, air is taken in from the first intake port 14. More specifically, when the first impeller 40, which is a centrifugal impeller, rotates, an airflow directed radially outward is generated. The airflow generated by the first impeller 40 flows toward the discharge port 110 along the inner surface of the housing 10.

Similarly, when the second impeller 50 rotates, air is taken in from the second intake port 15. More specifically, when the second impeller 50, which is a centrifugal impeller, rotates, an airflow directed radially outward is generated. The airflow generated by the second impeller 50 flows toward the discharge port 110 along the inner surface of the housing 10.

Since the blower A includes a plurality of intake ports, the area of all the intake ports in the blower A can be increased. As a result, the air volume can be increased as compared with the case where the intake port has a rib for holding the motor.

In the blower A, the distance between the support portion 22 of the base portion 20 and the bottom plate 111 is substantially equal to the distance between the support portion 22 of the base portion 20 and the lid portion 12. Therefore, the flow path area of the flow path of the airflow generated by the first impeller 40 is substantially the same as the flow path area of the flow path of the airflow generated by the second impeller 50.

The flow path area of the flow path of the airflow generated by the first impeller 40, and the first impeller 40 and the second impeller 50, are symmetrical with respect to the support portion 22 of the base portion 20. That is, the first impeller 40 and the second impeller 50 have the same outer diameter.

As a result, the blowing capacities of the first impeller 40 and the second impeller 50 are substantially equal. With this configuration, the flow velocity of the airflow generated by the first impeller 40 is substantially equal to the flow velocity of the airflow generated by the second impeller 50. As a result, when the airflow from the first impeller 40 and the airflow from the second impeller 50 merge at the end of the base portion 20, turbulence is less likely to occur. As a result, noise, vibration, and the like are suppressed.

Furthermore, the first impeller 40 and the second impeller 50 may have different sizes. For example, the first impeller 40 and the second impeller 50 may have different external shapes or different axial heights.

For example, when the distance from the base portion 20 to the first intake port 14 is longer than the distance from the base portion 20 to the second intake port 15, an impeller having a longer axial length than that of the second impeller 50 is employed as the first impeller 40. With this adjustment, the flow velocity of the airflow from the first impeller 40 and the flow velocity of the airflow from the second impeller 50 become substantially the same. Similarly, when the opening area of the first intake port 14 is smaller than the opening area of the second intake port 15, an impeller having an outer diameter smaller than that of the second impeller 50 is employed as the first impeller 40. Even in this case, the flow rate of the airflow from the first impeller 40 and the flow rate of the airflow from the second impeller 50 are substantially the same.

The air volumes of the first impeller 40 and the second impeller 50 vary depending on the sizes of the first impeller cup 43 and the second impeller cup 53. Therefore, when the first impeller 40 and the second impeller 50 have different shapes, the first impeller cup 43 of the first impeller 40 and the second impeller cup 53 of the second impeller 50 may have different sizes. Further, the configurations may have different shapes.

In the blower A, two impellers namely the first impeller 40 and the second impeller 50 are rotated by one motor 30. Since the number of motors 30 is one, the number of bearings can be reduced as compared with the case of using a plurality of motors. Thus, the configuration of the blower A can be simplified.

Although the example embodiment of the present disclosure has been described above, the respective configurations in the example embodiment and combinations thereof are merely examples, and addition, omission, substitution, and other alterations may be appropriately made within a range not departing from the gist of the present disclosure. Also note that the present disclosure is not limited by the example embodiment.

The configuration of the present disclosure can be used as a blower for sending air.

Features of the above-described preferred example embodiments and the modifications thereof may be combined appropriately as long as no conflict arises.

While example embodiments of the present disclosure have been described above, it is to be understood that variations and modifications will be apparent to those skilled in the art without departing from the scope and spirit of the present disclosure. The scope of the present disclosure, therefore, is to be determined solely by the following claims.

What is claimed is:

1. A blower comprising:

a base;

a motor attached to the base;

a first impeller to be rotated by the motor; and a second impeller to be rotated by the motor and independent of the first impeller; wherein the motor includes:

a rotor including a shaft rotatable about a central axis extending vertically;

a stator fixed to the base and radially opposing the rotor; and a bearing fixed to the stator and rotatably supporting the rotor;

the base includes:

a cover including an annular shape centered on the central axis and covering at least a portion of the motor in a radial direction;

a support that extends outward from an upper end of the cover; and a bottom that extends inward from a lower end of the cover and to which the stator is fixed;

the bottom includes a shaft hole in which the shaft is located in a penetrating state; and the first impeller and the second impeller are attached to an upper portion and a lower portion of the rotor, respectively.

2. The blower according to claim 1, wherein the cover is closer to the central axis as the cover extends downward.

3. The blower according to claim 2, wherein a blade of the second impeller is located radially outside the cover, and at least a portion of the blade overlaps the cover in a radial direction.

4. The blower according to claim 2, wherein the rotor includes:

a rotor magnet located radially outside the stator; and a rotor case having a tubular shape and holding the rotor magnet on an inner peripheral surface; and the rotor case is fixed to the shaft.

5. The blower according to claim 4, wherein at least a portion of the rotor case is located radially inside the cover, and radially opposes the cover.

6. The blower according to claim 4, wherein the first impeller is fixed to the rotor case, and the second impeller is directly fixed to the shaft.

7. The blower according to claim 1, further comprising a housing in which the base, the motor, the first impeller, and the second impeller are located inside, wherein the housing includes:

a first intake port located above the first impeller and axially opposing the first impeller; and a second intake port located below the second impeller and axially opposing the second impeller.

8. The blower according to claim 1, wherein the first impeller and the second impeller have a same outer diameter or substantially a same outer diameter.

9. The blower according to claim 8, wherein an impeller cup of the first impeller and an impeller cup of the second impeller have different sizes.

* * * * *